US006160836A

United States Patent [19]

Hansen

[11] Patent Number: 6,160,836

[45] Date of Patent: Dec. 12, 2000

[54] ELECTRO-SMOKELESS EXTRACTION/ RECOVERY SYSTEM

[76] Inventor: Jack L. Hansen, 2317 N. Overbrook Dr., Belleair Bluffs, Fla. 33770

[21] Appl. No.: 09/414,929

[22] Filed: Oct. 12, 1999

[51] Int. Cl.[7] ..... F27D 7/06

[52] U.S. Cl. ..... 373/110; 219/420; 373/5; 373/8

[58] Field of Search ..... 219/420, 424, 219/426, 429, 431, 432, 540; 373/8, 1, 5, 110; 48/111; 110/229, 250

[56] References Cited

U.S. PATENT DOCUMENTS 5,395,404 3/1995 Burckhalter ..... 48/111
5,650,083 7/1997 Bondeson et al. ..... 219/421

*Primary Examiner*—Tu Ba Hoang

[57] ABSTRACT

An electro-smokeless extraction/recovery system for converting shredded scrap tires to carbon black and steel and fluid discharge of oil, gas and solvent chemicals. A reaction vessel is formed with a side wall and a bottom plate. The bottom plate is provided with a plurality of heat apertures and a plurality of drain apertures. The vessel also has an open top for receipt of waste and shredded scrap tires. The lid is adapted to be removably placed over the top. A plurality of electrical heating elements are positioned through the bottom of the reaction vessel to heat the waste and shredded scrap tires within the vessel. A plurality of hollow drain members each have a side wall and a top with an open bottom positioned in sealing relationship with drain apertures. Vertically extending openings on at least a portion of a side wall extend upwardly from the bottom plate to a location adjacent to the top to effect the flow of fluid discharge from the reaction vessel.

15 Claims, 6 Drawing Sheets

FIG 5
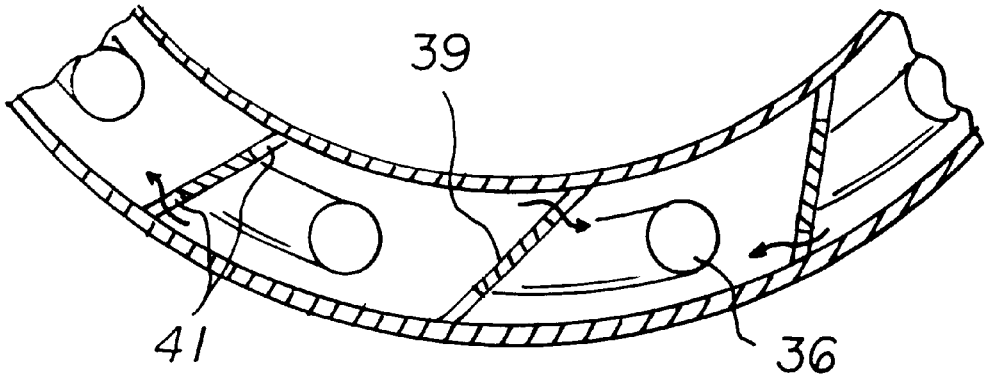
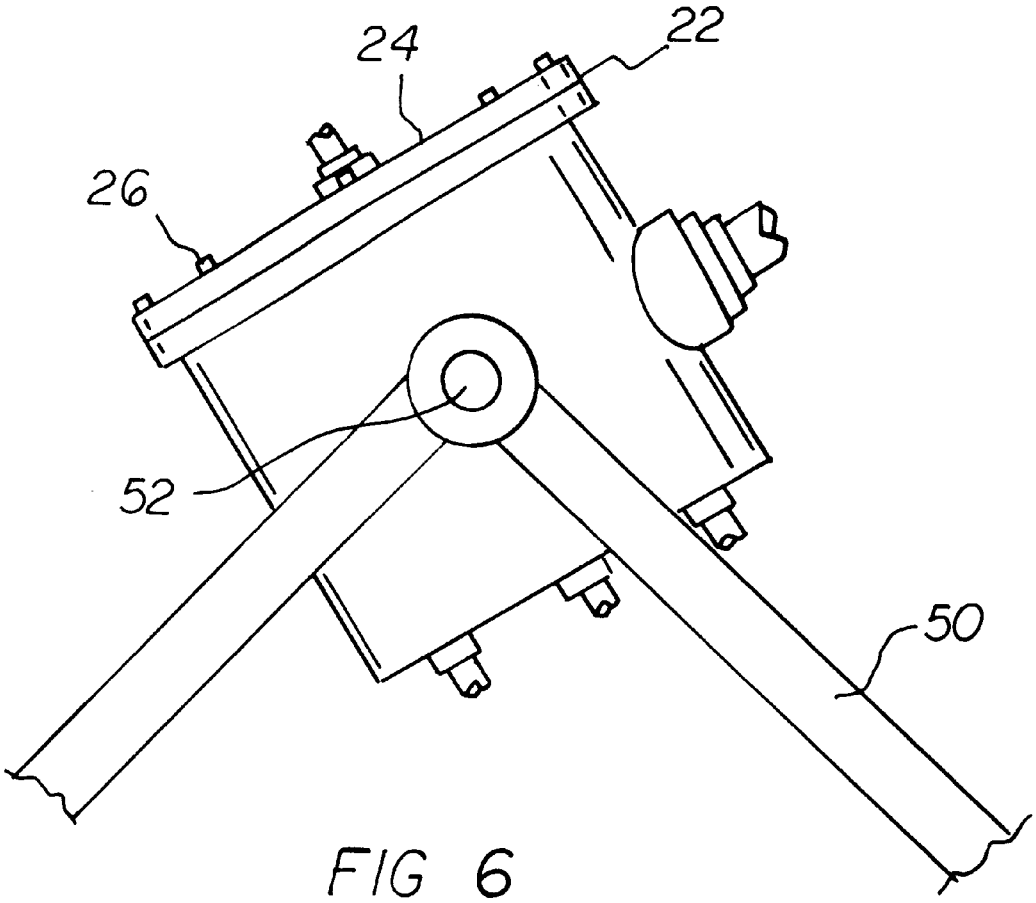
FIG 6

FIG 9
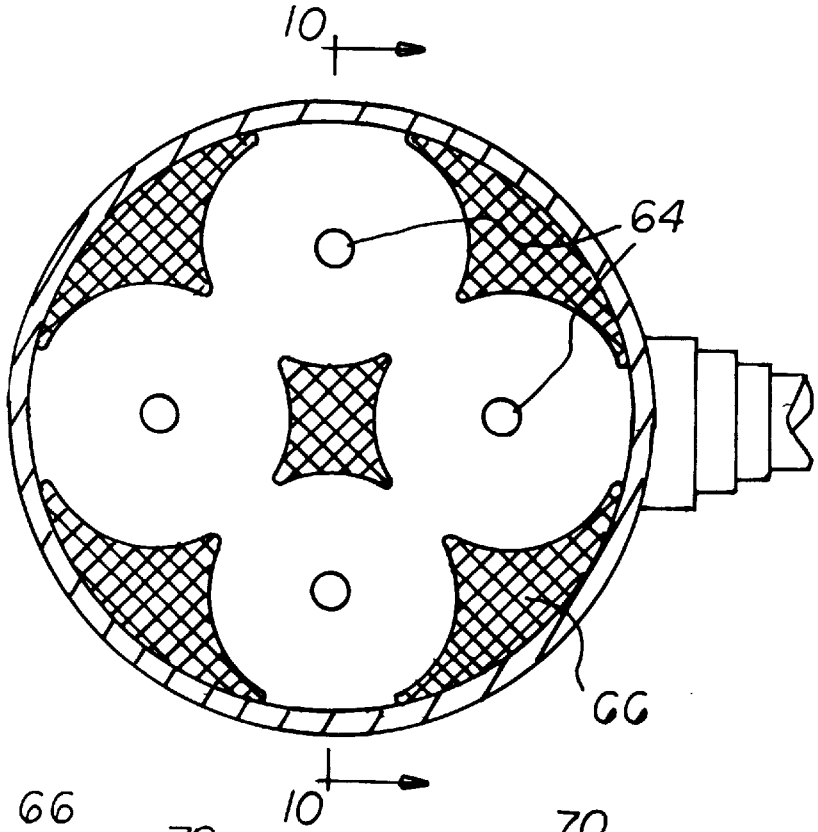
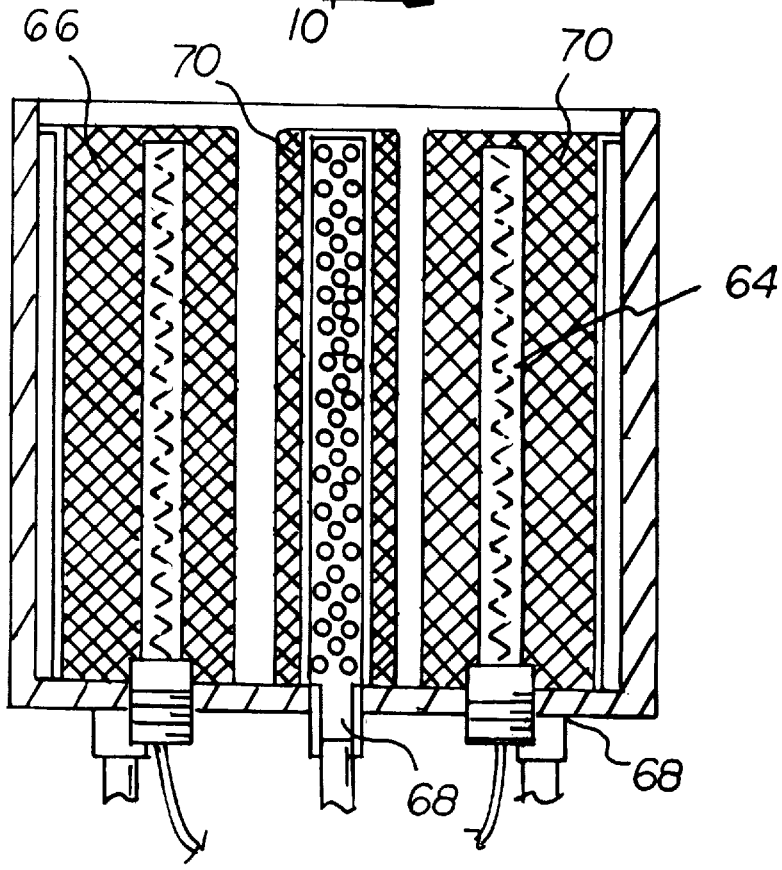
FIG 10

FIG 11
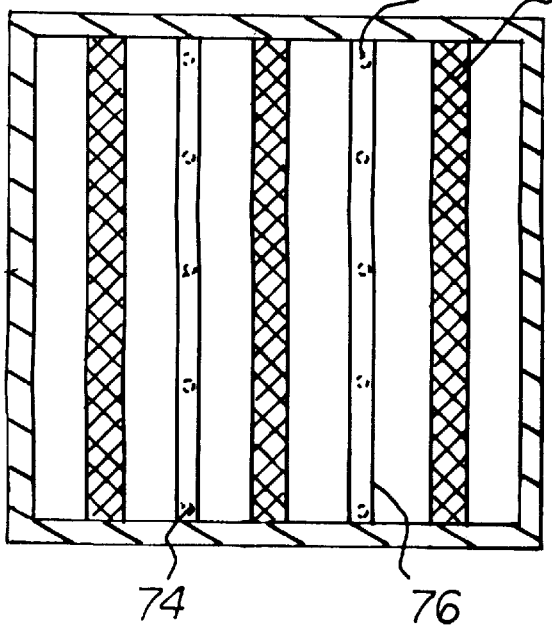
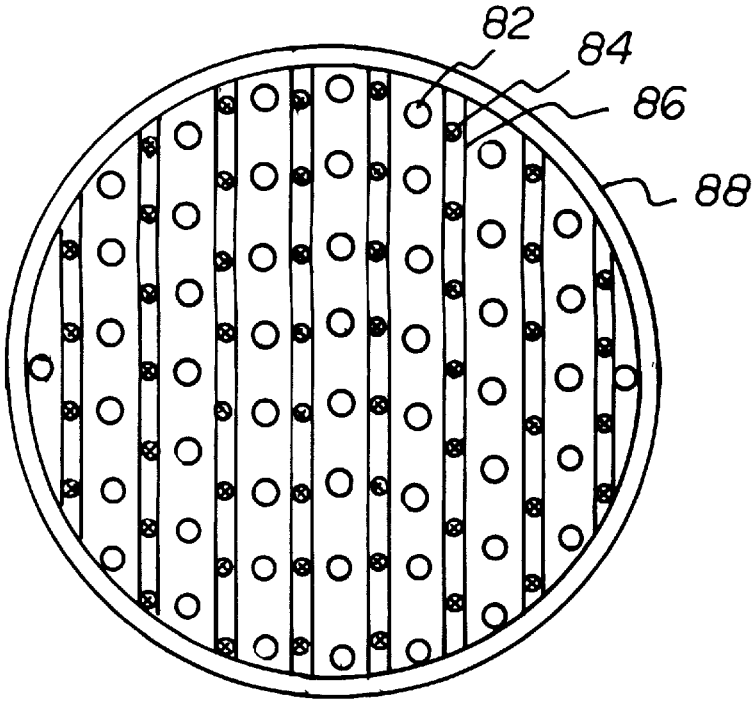
FIG 12

ELECTRO-SMOKELESS EXTRACTION/ RECOVERY SYSTEM

BACKGROUND OF THE INVENTION

This application is based upon a Provisional Application Registration No. 36,110 to Jack Lester Hansen filed Mar. 19, 1998.

1. Field of the Invention

The present invention relates to a reclamation system and more particularly pertains to reclaiming chemicals from scrap tires through convection, conduction and radiation to extract usable gas, oil and carbon black.

2. Description of the Prior Art

The use of heating and reclamation devices is known in the prior art. More specifically, heating and reclamation devices heretofore devised and utilized for the purpose of reclaiming used elastomeric materials are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,090,054 to Heine et al discloses a preheating apparatus for foundry ladles. U.S. Pat. No. 5,316,708 to Drews discloses a method for making products made from recycled vehicle tires. U.S. Pat. No. 5,395,404 to Burckhalter discloses an apparatus for heating whole tires in a pressure vessel. U.S. Pat. No. 5,733,943 to Doan discloses street signs and other products and method for making same from used rubber tires. Lastly, U.S. Pat. No. 5,800,754 to Woods discloses building materials from recycled tires.

While these devices fulfill their respective, particular objectives and requirements, the aforementioned patents do not describe a tire reclamation system that allows reclaiming used elastomeric materials.

In this respect, the electro-smokeless extraction/recovery system according to the present invention substantially departs from the conventional concepts and designs of the prior art, and in doing so provides an apparatus primarily developed for the purpose of reclaiming chemicals from scrap tires through convection, conduction and radiation to produce usable gases, oil, solvents, and carbon black.

Therefore, it can be appreciated that there exists a continuing need for a new and improved extraction chemical reclamation system which can be used for reclaiming chemicals (non-renewable natural resources, elements, etc.) from scrap tires and waste (farm waste, hazardous medical waste, etc.) through convection, conduction and radiation to produce usable gases, oils, solvent chemicals, and carbon black. In this regard, the present invention substantially fulfills this need.

SUMMARY OF THE INVENTION

In view of the foregoing disadvantages inherent in the known types of heating and reclamation devices now present in the prior art, the present invention provides an improved tire reclamation system. As such, the general purpose of the present invention, which will be described subsequently in greater detail, is to provide a new and improved waste, tire, chemical reclamation system and method which has all the advantages of the prior art and none of the disadvantages.

To attain this, the present invention essentially comprises a new and improved electro-smokeless extraction/recovery system for converting waste and shredded tires to carbon black and fluid discharge of oil and solvent and gases and chemicals. In the preferred embodiment, a reaction vessel is formed with a generally cylindrical side wall and a bottom plate. The bottom plate has a plurality of heat apertures and a plurality of drain apertures there through. The vessel also has an open top for the receipt of waste and shredded scrap tires. A lid is provided and is adapted to be removably placed over the top with sealing bolts for the purpose of sealing the reaction vessel to allow for pressurized heating in the absence of oxygen, a combustion making gas. A plurality of hollow sheaths are formed of a thermally conductive material. Each sheath has spaced concentric cylindrical side walls, a closed top, and an open bottom positioned in sealing relationship with the heat apertures and a space extending upwardly therefrom to a location adjacent to the top. A plurality of electrical heating elements are provided within the sheaths and positioned through the open bottom of the sheath. Each heating element or tube is comprised of a hollow cylindrical rod with heating coils inside. Baffles are positioned between each heating tube at an angle of about 45 degrees to equally reflect heat and equalize the heat. Spaces allow for the full flow of heated air. Each heating element is adapted to heat adjacent waste and shredded scrap tires through the sheath by conduction through the transfer of thermal radiation energy from the sheath through the waste and shredded scrap tires in the vessel, convection through the flow of heated air and gas flow between the inter-particle spacing between the waste and shredded scrap tires in the vessel, and radiation across the space between shredded tires in the vessel. Each heating element may be vertical, perpendicular to the bottom blate, but is preferably slated into a spiral configuration and adapted to operate at between about 200 and 3,000, preferably about 1,700, degrees Fahrenheit at between about 1 psi and 20 psi, preferably about 10 psi, for between about 15 and 60, preferably 40, minutes. The times and temperatures are selected for any particular application. Next provided are a plurality of hollow drains. Each drain has spaced concentric cylindrical or oval side walls and a top. Each channel and/or drain also has an open bottom positioned in sealing relationship with drain apertures. Openings, in the form of screens, are provided on at least a portion of the side walls of each drain. The openings extend upwardly from the bottom plate to a location adjacent to the top to effect the flow of fluid discharge from the reaction vessel. Support means are provided for the reaction vessel. The support means are provided with pivot pin for optionally adjusting the angular orientation of the reaction vessel.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved non-renewable chemical energy and electrical reclamation system which has all of the advantages of the prior art heating and reclamation devices and none of the disadvantages.

It is another object of the present invention to provide a new and improved non-renewable chemical energy reclamation system which may be easily and efficiently manufactured and marketed.

It is further object of the present invention to provide a new and improved tire chemical reclamation system which is of durable and reliable constructions.

An even further object of the present invention is to provide a new and improved waste and scrap tire chemical reclamation system which is susceptible of a low cost of manufacture with regard to both materials and labor, and which accordingly is then susceptible of low prices of sale to the public, thereby making such waste and scrap tire reclamation system economically available and environmentally safe.

Even still another object of the present invention is to provide a scrap tire chemical reclamation system for reclaiming shredded waste tire chemicals through convection, conduction and radiation to reclaim usable gas, oil, steel and carbon black.

Lastly, it is an object of the present invention to provide an electro-smokeless extraction/recovery system for converting shredded scrap tires to carbon black and fluid discharge of oil, gas and solvent chemicals. A reaction vessel is formed with a side wall and a bottom plate. The bottom plate is provided with a plurality of heat apertures and a plurality of drain apertures. The vessel also has an open top for receipt of waste and shredded scrap tires. The lid is adapted to be removably placed over the top. A plurality of electrical heating elements are positioned through the bottom of the reaction vessel to heat the waste and shredded scrap tires within the vessel. A plurality of hollow drain members each have a side wall and a top with an open bottom positioned in sealing relationship with drain apertures. Vertically extending openings on at least a portion of a side wall extend upwardly from the bottom plate to a location adjacent to the top to effect the flow of fluid discharge from the reaction vessel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view taken along line 5—5 of FIG. 4.

FIG. 6 is a side elevational view illustrating tipping mechanisms for varying the angle of operations.

FIG. 9 is a top elevational view similar to FIGS. 3 and 7, but illustrating an alternate cylindrical embodiment of the invention.

FIG. 10 is a cross sectional view taken along line 10—10 of FIG. 9.

FIG. 11 is a top elevational view of another rectangular embodiment of the invention.

FIG. 12 is a top elevational view of an additional alternate cylindrical embodiment of the invention.

The same reference numerals refer to the same parts throughout the various Figures.

DESCRIPTION OF THE PREFERRED EMBODIMENT

Figure 1:
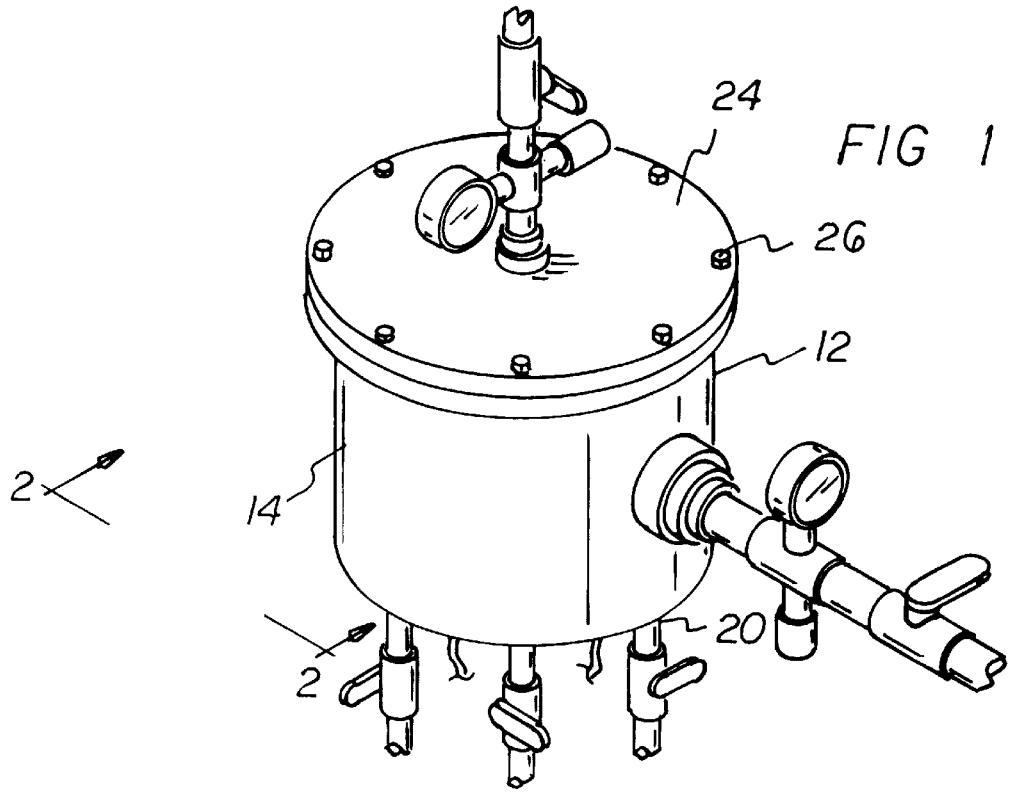
FIG. 1 is a perspective illustration of the new and improved tire reclamation system constructed in accordance with the principles of the present invention.
Figure 2:
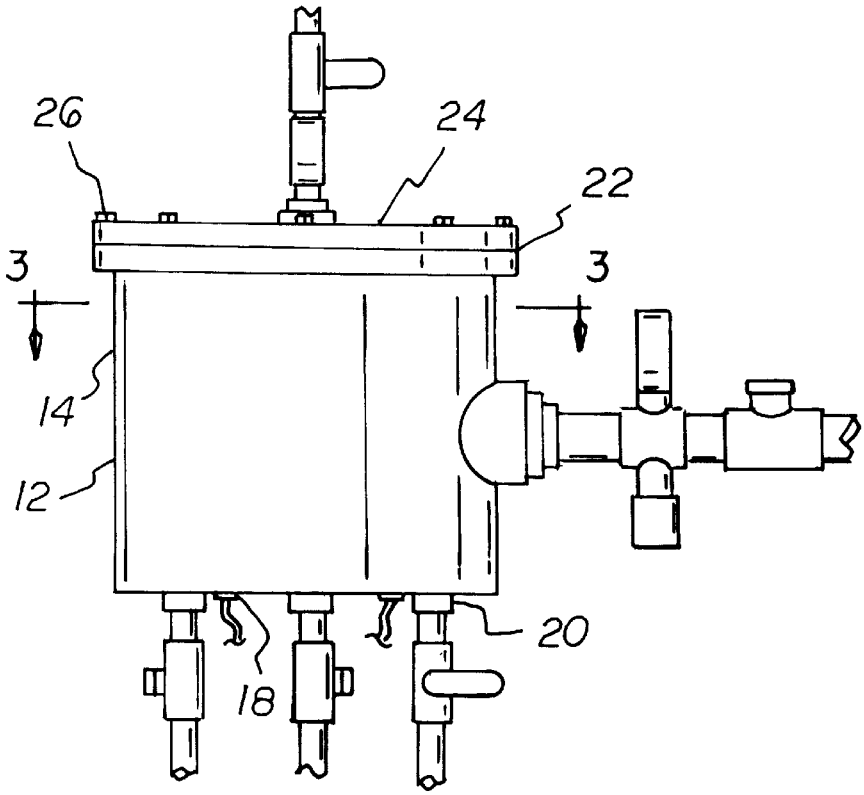
FIG. 2 is a side elevational view of the system shown in FIG. 1.
Figure 3:
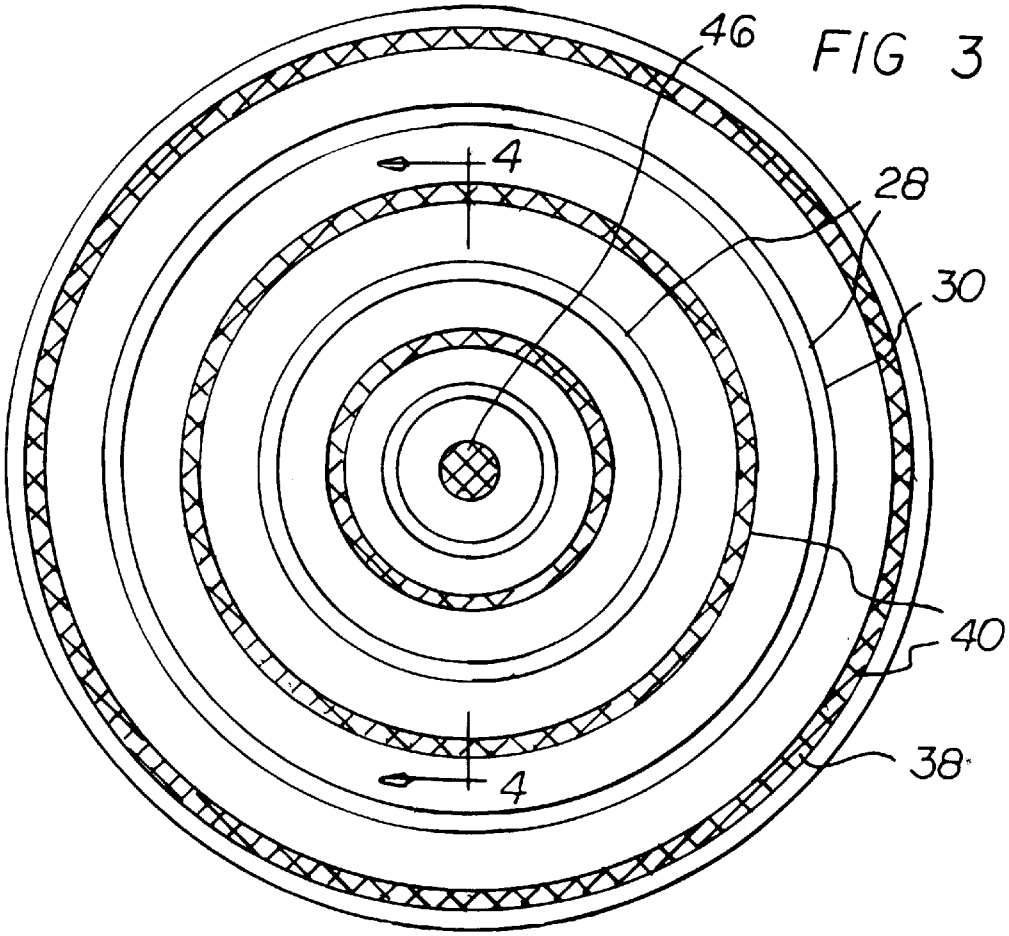
FIG. 3 is a top elevational view of the system shown in FIGS. 1 and 2 but with the lid removed.
Figure 4:
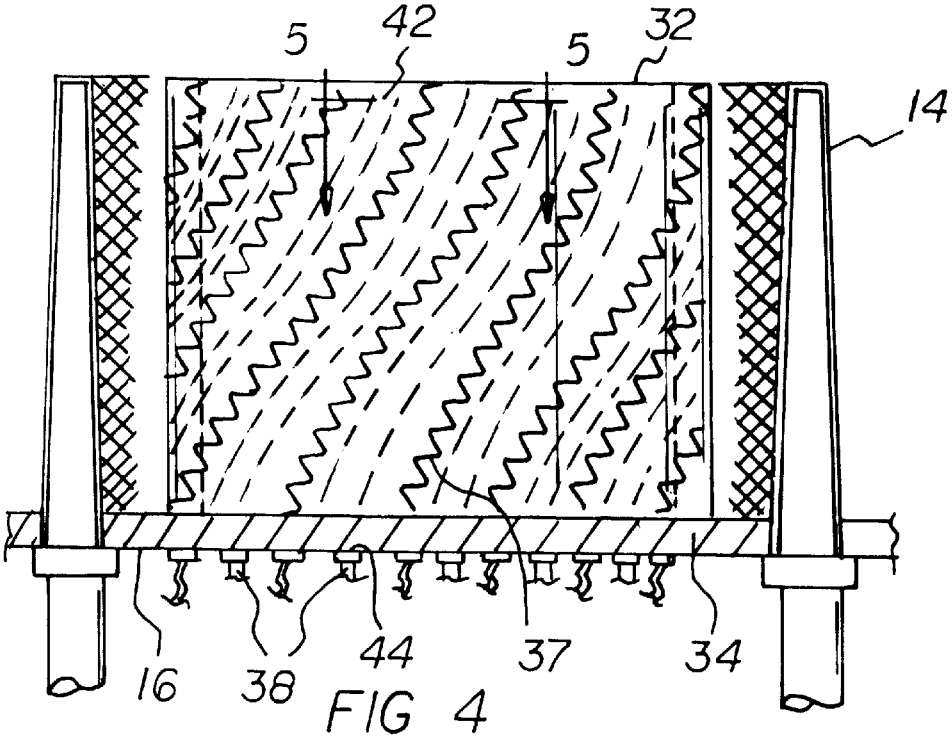
FIG. 4 is a cross sectional view taken along line 4—4 of FIG. 3.

With reference now to the drawings, and in particular to FIG. 1 thereof, the preferred embodiment of the new and improved tire reclamation system embodying the principles and concepts of the present invention and generally designated by the reference numeral 10 will be described.

The present invention, electro-smokeless extraction/recovery system is comprised of a plurality of components. Such components in their broadest context include a reaction vessel, a plurality of hollow sheaths, a plurality of electrical heating elements, and a plurality of hollow drain members. Such components are individually configured and correlated with respect to each other so as to attain the desired objective.

The present invention essentially comprises a new and improved electro-smokeless extraction/recovery system for converting waste and shredded tires to carbon black and fluid discharge of oil and solvent and gases and chemicals and steel, such being done, preferably with zero air emissions. In the preferred embodiment, a reaction vessel 12 is formed with a generally cylindrical side wall 14 and a bottom plate 16. The bottom plate has a plurality of heat apertures 18 and a plurality of drain apertures 20 there through. The vessel also has an open top 22 for the receipt of waste and shredded scrap tires. A lid 24 is provided and is adapted to be removably placed over the top with sealing bolts 26 for the purpose of sealing the reaction vessel to allow for pressurized heating in the absence of oxygen, a combustion making gas.

A plurality of hollow sheaths 28 are formed of a thermally conductive material. Each sheath has spaced concentric cylindrical side walls 30, a closed top 32, and an open bottom 34 positioned in sealing relationship with the heat apertures 18 and a space extending upwardly therefrom to a location adjacent to the top 32.

A plurality of electrical heating elements 36 are provided within the sheaths and positioned through the open bottom of the sheath. Each heating element or tube 36 is comprised of a hollow cylindrical rod with heating coils inside. Baffles 39 are positioned between each heating tube at an angle of about 45 degrees to equally reflect heat and equalize the heat. Spaces 41 allow for the full flow of heated air. Each heating element is adapted to heat adjacent waste and shredded scrap tires through the sheath by conduction through the transfer of thermal energy from the sheath through the waste and shredded scrap tires in the vessel, convection through the flow of heated air and gas flow between the inter-particle spacing between the waste and shredded scrap tires in the vessel, and radiation across the space between shredded tires in the vessel. Each heating element may be vertical, perpendicular to the bottom plate, but is preferably slated into a spiral configuration and adapted to operate at between about 200 and 3,000, preferably about 1,700, degrees Fahrenheit at between about 1 psi and 20 psi, preferably about 15 psi, for between about 15 and 60, preferably 40, minutes. The times and temperatures are selected for any particular application. The distance between the sheaths containing the heating elements is between 2 inches and 24 inches, preferably 10 inches. The size of the mass of material to be heated is preferably between 500 pounds and 2,000 pounds, preferably 1,000 pounds.

Next provided are a plurality of hollow drains 38. Each drain has spaced concentric cylindrical side walls 40 and a top 42. Each drain also has an open bottom 44 positioned in sealing relationship with drain apertures. Openings in the form of screens are provided on at least a portion of the side walls of each drain. The openings extend upwardly from the bottom plate to a location adjacent to the top to effect the flow of fluid discharge from the reaction vessel. A screen cylinder 46 is located at the center of the vessel.

Support means 50, as shown in FIG. 6, are provided for the reaction vessel. The support means are provided with pivot pin 52 for adjusting the angular orientation of the reaction vessel and holding it in such orientation for a particular application.

Figure 7:
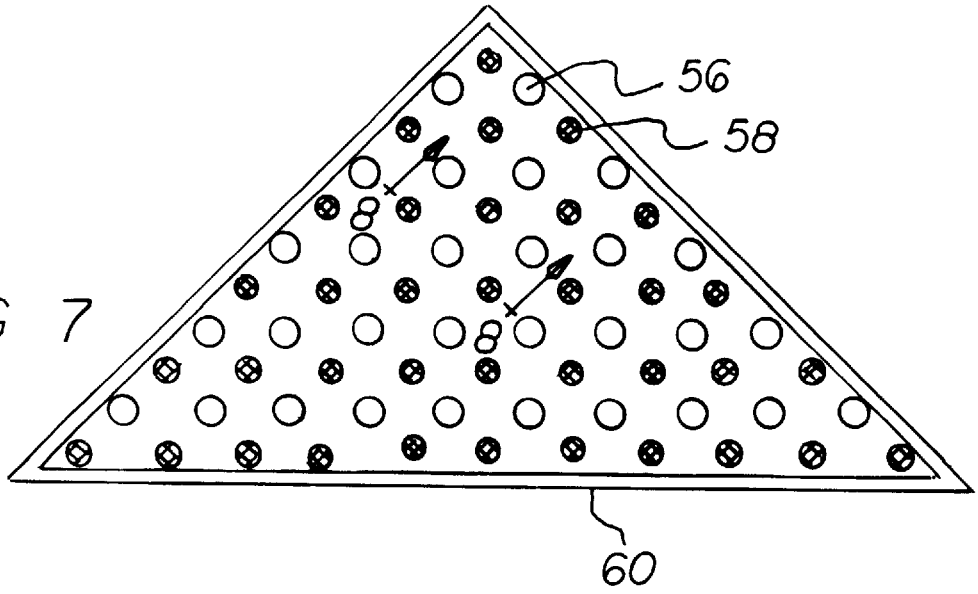
FIG. 7 shows a top view of an alternate triangular embodiment of the invention.
Figure 8:
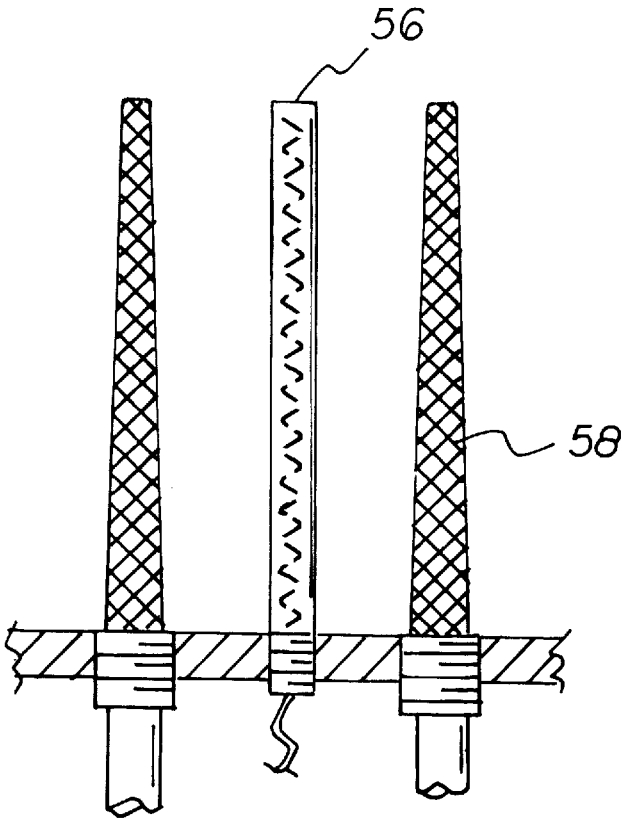
FIG. 8 is a cross sectional view taken along line 8—8 of FIG. 7.

As shown in FIGS. 7 and 8, an alternate embodiment of the invention is formed wherein the heating elements 56 are essentially cylindrical and spaced from each other and drain members 58 are essentially cylindrical and spaced from each other. The preferred spacing between heating elements is between about 2 inches and 24 inches, preferably about 10 inches, from each other. This embodiment employs heating elements and drain members in a triangular configuration to match the triangular configuration of the reaction vessel 60. This arrangement maximizes the heat output in a flat walled reaction vessel.

The embodiment of FIGS. 9 and 10, the third embodiment or second alternate embodiment, features heating elements 64 which are essentially cylindrical and the drain members are screens 66 configured to hold the waste and shredded scrap tires in an essentially cylindrical configuration around the heating elements. Drains 68 are located in the base of the housing beneath the screened areas 70.

FIG. 11, the fourth embodiment or third alternate embodiment, relates to an embodiment wherein the heating elements 74 are cylindrical with generally rectilinear sheaths 76 receiving the heating elements. This construction with heating elements within sheaths allows for the removal, repair and replacement of heating elements without opening the reaction vessel. The drains are screens 78 in a rectilinear configuration with drains there beneath.

FIG. 12, the fifth embodiment or fourth alternate embodiment, employs drain members 82 as cylinders and heating members 54 in sheaths 86. The heating elements and drain members are spaced and parallel with respect to each other. They extend from edge to edge of a cylindrical reaction vessel 88. The rectilinear configuration is the simplest to fabricate.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electro-smokeless extraction/recovery system with zero air emissions for converting waste and shredded scrap tires to carbon black and steel and fluid discharge of oil, fuel, and chemical gases comprising, in combination:

a reaction vessel formed with a generally cylindrical side wall and a bottom plate having a plurality of heat apertures and a plurality of drain apertures therethrough, the vessel also having an open top for the receipt of waste and shredded scrap tires with a lid adapted to be removably placed over the top with sealing bolts for sealing purposes to allow for pressurized heating in the absence of air;

a plurality of hollow sheaths formed of a thermally conductive material each sheath having spaced concentrical cylindrical side walls and a closed top and an open bottom positioned in sealing relationship with the heat aperture and extending upwardly therefrom to a location adjacent to the top;

a plurality of electrical heating elements within each sheath positioned through the open bottom of the sheath to heat the shredded tires within the vessel, each heating element adapted to heat adjacent waste and shredded scrap tires through the sheath by conduction through the transfer of thermal energy from the sheath through the waste and shredded scrap tires in the vessel, convection through the flow of heated air and gas flow between the inter-particle spacing between the waste and shredded scrap tires in the vessel, and radiation across the space between shredded tires in the vessel, the heating element being in a spiral configuration and adapted to operate at between about 200 and 3,000 degrees Fahrenheit at between about 1 and 20 psi for between about 15 and 60 minutes the sheaths containing the heating elements being between about 2 and 24 inches apart;

a plurality of hollow drains, each having spaced concentric cylindrical side walls and a top with an open bottom positioned in sealing relationship with drain apertures, each drain also having vertically extending openings on at least a portion of the side walls thereof and extending upwardly from the bottom plate to a location adjacent with spaced baffles within each drain to the top to effect the flow of fluid discharge from the reaction vessel; and support means for the reaction vessel with a pivot pin for adjusting the angular orientation of the reaction vessel.

2. An electro-smokeless extraction/recovery system for converting waste and shredded scrap tires to carbon black and fluid discharge of oil, gas, and solvent chemicals comprising:

a reaction vessel formed with a side wall and a bottom plate having a plurality of heat apertures and a plurality of drain apertures therethrough, the vessel also having an open top for the receipt of waste and shredded scrap tires with a lid adapted to be removably placed over the top of the vessel;

a plurality of electrical heating elements positioned through the bottom of the reaction vessel to heat the waste and shredded scrap tires within the vessel; and a plurality of hollow drain members, each having a side wall and an upper end and with an open bottom positioned in sealing relationship with drain apertures, each drain member also having vertically extending openings on at least a portion of a side wall thereof and extending upwardly from the bottom plate to a location adjacent to the upper end to effect the flow of fluid discharge from the reaction vessel.

3. The system as set forth in claim 2 and further including a plurality sheaths enclosing the heating elements.

4. The system as set forth in claim 3 wherein the sheath members are concentric hollow cylinders with a plurality of spaced heating elements in each sheath.

5. The system as set forth in claim 4 wherein the heating elements are arranged in a spiral configuration.

6. The system as set forth in claim 2 wherein the drain members are concentric hollow cylinders.

7. The system as set forth in claim 6 and further including a plurality of spaced baffles within in each drain member.

8. The system as set forth in claim 2 wherein the heating elements are spaced at between about 2 and 24 inches from each other and drain members are essentially cylindrical.

9. The system as set forth in claim 2 wherein the heating elements are essentially cylindrical and the drain members are screens configured to hold the waste and shredded scrap tires in an essentially cylindrical configuration around the heating elements.

10. The system as set forth in claim 2 wherein the heating elements are cylindrical with generally rectilinear sheaths receiving the heating elements.

11. The system as set forth in claim 10 wherein the drain members are rectilinear and equally spaced between the sheaths.

12. The system as set forth in claim 2 wherein the heating elements and drain members are in a triangular configuration.

13. The system as set forth in claim 2 wherein the reaction vessel is cylindrical.

14. The system as set forth in claim 2 wherein the reaction vessel is rectilinear.

15. The system as set forth in claim 2 wherein the reaction vessel is triangular.

* * * * *